US011466949B2

(12) United States Patent
Kellgren et al.

(10) Patent No.: US 11,466,949 B2
(45) Date of Patent: Oct. 11, 2022

(54) FOLDING FIREARM

(71) Applicant: Kel-Tec CNC Industries Inc., Cocoa, FL (US)

(72) Inventors: George Kellgren, Cocoa, FL (US); Ryan Williams, Cocoa, FL (US)

(73) Assignee: KEL-TEC CNC INDUSTRIES, INC., Cocoa, FL (US)

( * ) Notice: Subject to any disclaimer, the term of this patent is extended or adjusted under 35 U.S.C. 154(b) by 0 days.

(21) Appl. No.: 17/146,235

(22) Filed: Jan. 11, 2021

(65) Prior Publication Data

US 2021/0372723 A1 Dec. 2, 2021

Related U.S. Application Data

(60) Provisional application No. 62/960,230, filed on Jan. 13, 2020.

(51) Int. Cl.

| | |
|---|---|
| ***F41A 11/04*** | (2006.01) |
| ***F41G 1/16*** | (2006.01) |
| ***F41A 21/30*** | (2006.01) |

(52) U.S. Cl.

CPC ..... *F41A 11/04* (2013.01); *F41A 21/30* (2013.01); *F41G 1/16* (2013.01)

(58) Field of Classification Search

CPC ..... F41A 11/04; F41A 21/30; F41A 21/48; F41G 1/02; F41G 1/06; F41G 1/16; F41G 1/17

USPC ..... 42/71.02

See application file for complete search history.

(56) References Cited

U.S. PATENT DOCUMENTS 521,202 A * 6/1894 Burgess ..... F41A 11/04 42/71.01
4,426,910 A * 1/1984 Speer ..... F41A 11/04 224/911
4,501,189 A * 2/1985 Brandl ..... F41A 21/30 89/14.4

(Continued)

OTHER PUBLICATIONS

Author Unknown, Heckler & Koch MP5, downloaded Jan. 24, 2022, Wikipedia, 1-34, found here: https://en.wikipedia.org/wiki/Heckler_%26_Koch_MP5. (Year: 2022).*

(Continued)

*Primary Examiner* — Bret Hayes
(74) *Attorney, Agent, or Firm* — Bennet K. Langlotz; Langlotz Patent & Trademark Works, LLC

(57) ABSTRACT

Folding firearms have a frame having a trigger assembly and defining a passage containing a bolt, a barrel assembly pivotally connected to the frame, the barrel assembly including a barrel element defining a barrel axis, the barrel element including a barrel, a plurality of suppressor baffles forward of the barrel, and having an interior space, the barrel assembly including a sleeve encompassing the barrel, the sleeve having an interior defining an expansion chamber in gas communication with the interior space of the barrel element, a front closure and a rear closure at respective ends of the sleeve to provide a gas seal enclosing the expansion chamber, and the sleeve being rotatable about the barrel axis. The sleeve may be movable between an operating condition in which the sight facility is in a first position and a stowage condition in which the sight facility is rotationally offset from the first position.

19 Claims, 9 Drawing Sheets

(56) References Cited

U.S. PATENT DOCUMENTS

| | | | | |
|---|---|---|---|---|
| 4,625,621 | A * | 12/1986 | Warin | F41C 9/02 42/1.09 |
| 5,679,916 | A * | 10/1997 | Weichert | F41A 21/30 181/223 |
| 7,739,821 | B1 * | 6/2010 | Hamme | F41C 9/02 42/8 |
| 9,103,618 | B2 * | 8/2015 | Daniel | F41A 21/325 |
| 2009/0277066 | A1 * | 11/2009 | Burt | F41A 3/66 42/6 |
| 2019/0212095 | A1 * | 7/2019 | Ballard | F41C 7/11 |

OTHER PUBLICATIONS

Red Lion Precision, LLC, "Gen 1 Sub 2000 Forend (Base unit, no rails)," https://www.redlionprecision.com/ProductDetails.asp?ProductCode=R6, (c) 2020, Accessed Nov. 5, 2020.

Red Lion Precision, LLC, "Gen 1 Sub 2000 Forend (Base unit, no rails)," https://www.redlionprecision.com/ProductDetails.asp?ProductCode=R11, (c) 2020, Accessed Nov. 5, 2020.

* cited by examiner

FOLDING FIREARM

CROSS-REFERENCE TO RELATED APPLICATION

This application claims the benefit of U.S. Provisional Patent Application No. 62/960,230 filed on Jan. 13, 2020, entitled "Weapon with integrated suppressed barrel with rotating suppressor tube forend to rotate optics and accessories out of the line of sight, to reduce overall height for compact storage," which is hereby incorporated by reference in its entirety for all that is taught and disclosed therein.

FIELD OF THE INVENTION

The present invention relates to firearms, and more particularly to a firearm that has an integrated suppressed barrel with a rotating suppressor tube forend to enable folding despite attached optics.

BACKGROUND AND SUMMARY OF THE INVENTION

Folding firearms are popular for their ability to fold for compact storage. Two prior art examples of such a folding firearm is the SUB-9 and SUB2000 carbine rifles manufactured by KelTec Weapons of Cocoa, Fla. They include a folding barrel assembly that folds about a hinge axis to reduce the overall length of the weapon nearly by half. This enables the user to secure the folded firearm in a smaller space as opposed to a larger, rifle-sized gun safe. The folding feature also allows the folded firearm to fit snugly in a small backpack or a briefcase-style container instead of a full-length rifle case for ease of transport.

The disadvantage to these prior art folding firearms is that any mounted optics or added accessories may obstruct folding of the host firearm altogether or limit the extent the host firearm can be folded. Although the mounted optics or accessories could be removed from the weapon prior to folding, this could be frustrating to many users. Not only would the firearm not be immediately ready for use upon unfolding because the items must first be reattached, but mounted optics or other sighting systems might have to be zeroed again to ensure accuracy.

An alternative approach to removing any mounted optics or added accessories prior to folding the firearm is to replace the original factory forend on the SUB2000 carbine rifle with an after-market rotating forend. Examples of rotating forends are the Gen1 and Gen2 Sub 2000 forends manufactured by Red Lion Precision, LLC of Red Lion, Pa. The forends rotate in 90° indexed increments, which permits the user to fold the weapon despite optics remaining mounted. The design also enables the user to rotate the optics back into the line of sight for normal firearm operation without disturbing their zero. While this is an effective solution to the problem of not being able to fold the firearm with attached optics or accessories, it is expensive and adds considerable weight to what is otherwise a comparatively inexpensive firearm to purchase and operate. This approach also does not incorporate any suppression capability to reduce the auditory report on weapon discharge, which if added further increases cost, weight, and overall length of the host firearm.

Therefore, a need exists for a new and improved folding firearm that has an integrated suppressed barrel with a rotating suppressor tube forend to enable folding despite attached optics. In this regard, the various embodiments of the present invention substantially fulfill at least some of these needs. In this respect, the folding firearm according to the present invention substantially departs from the conventional concepts and designs of the prior art, and in doing so provides an apparatus primarily developed for the purpose of providing a folding firearm having an integrated suppressed barrel with a rotating suppressor tube forend to enable folding despite attached optics.

The present invention provides an improved folding firearm, and overcomes the above-mentioned disadvantages and drawbacks of the prior art. As such, the general purpose of the present invention, which will be described subsequently in greater detail, is to provide an improved folding firearm that has all the advantages of the prior art mentioned above.

To attain this, the preferred embodiment of the present invention essentially comprises a frame having a trigger assembly and defining a passage containing a bolt, a barrel assembly pivotally connected to the frame, the barrel assembly including a barrel element defining a barrel axis, the barrel element including a barrel, a plurality of suppressor baffles forward of the barrel, and having an interior space, the barrel assembly including a sleeve encompassing the barrel, the sleeve having an interior defining an expansion chamber in gas communication with the interior space of the barrel element, a front closure and a rear closure at respective ends of the sleeve to provide a gas seal enclosing the expansion chamber, and the sleeve being rotatable about the barrel axis. The sleeve may be movable between an operating condition in which the firearm is operable and the sight facility is in a first position and a stowage condition in which the sight facility is rotationally offset from the first position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
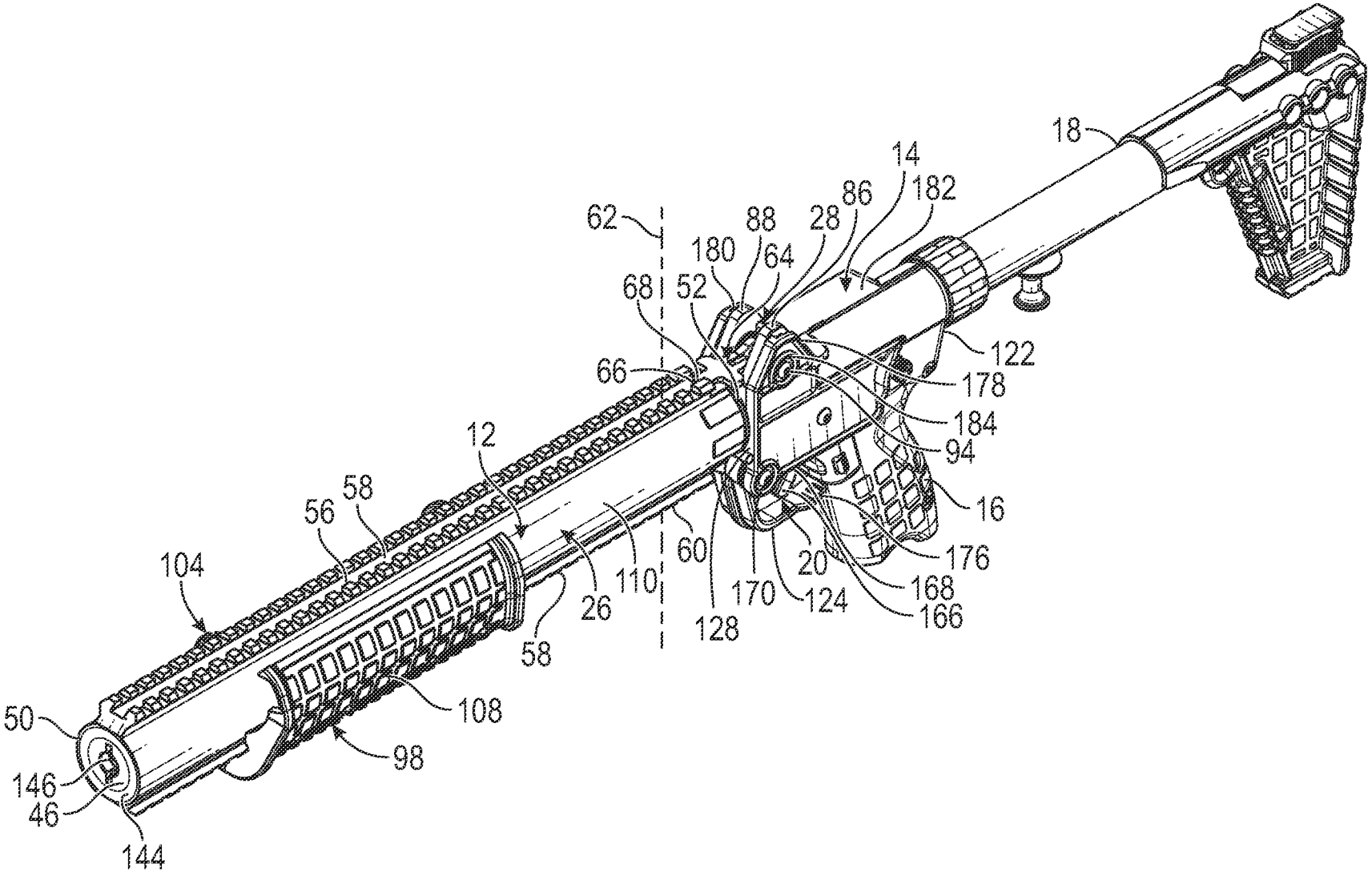
FIG. 1 is a top isometric view of the current embodiment of a folding firearm constructed in accordance with the principles of the present invention with the sleeve in the operating condition.

An embodiment of the folding firearm of the present invention is shown and generally designated by the reference numeral 10.

Figure 2:
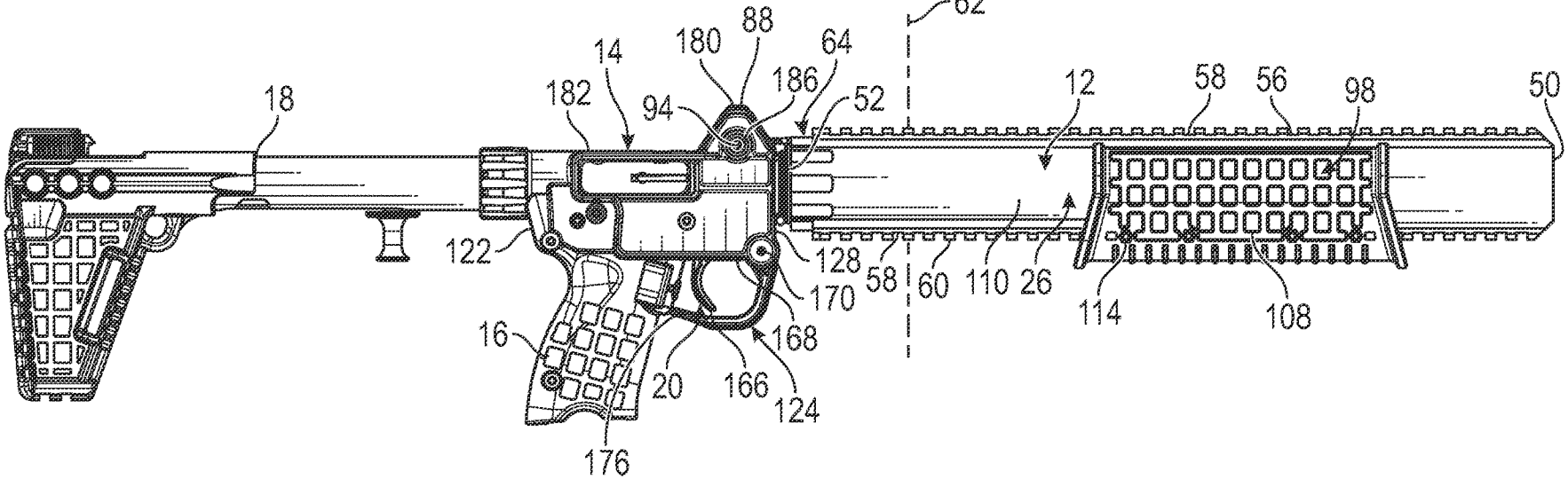
FIG. 2 is a right side view of the folding firearm of FIG. 1 with the sleeve in the operating condition.
Figure 3:
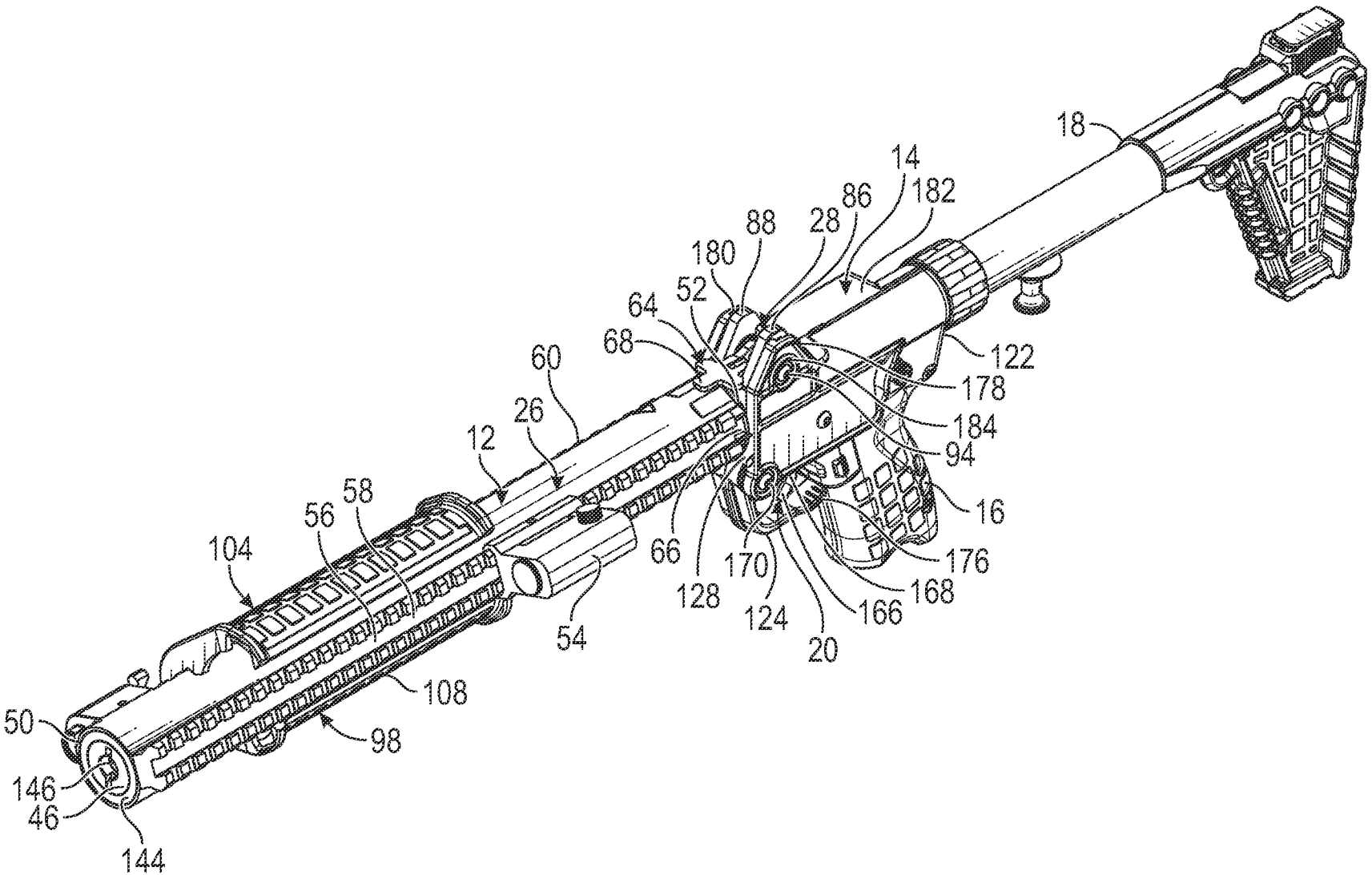
FIG. 3 is a top isometric view of the folding firearm of FIG. 1 with the sleeve in the stowage condition.
Figure 4:
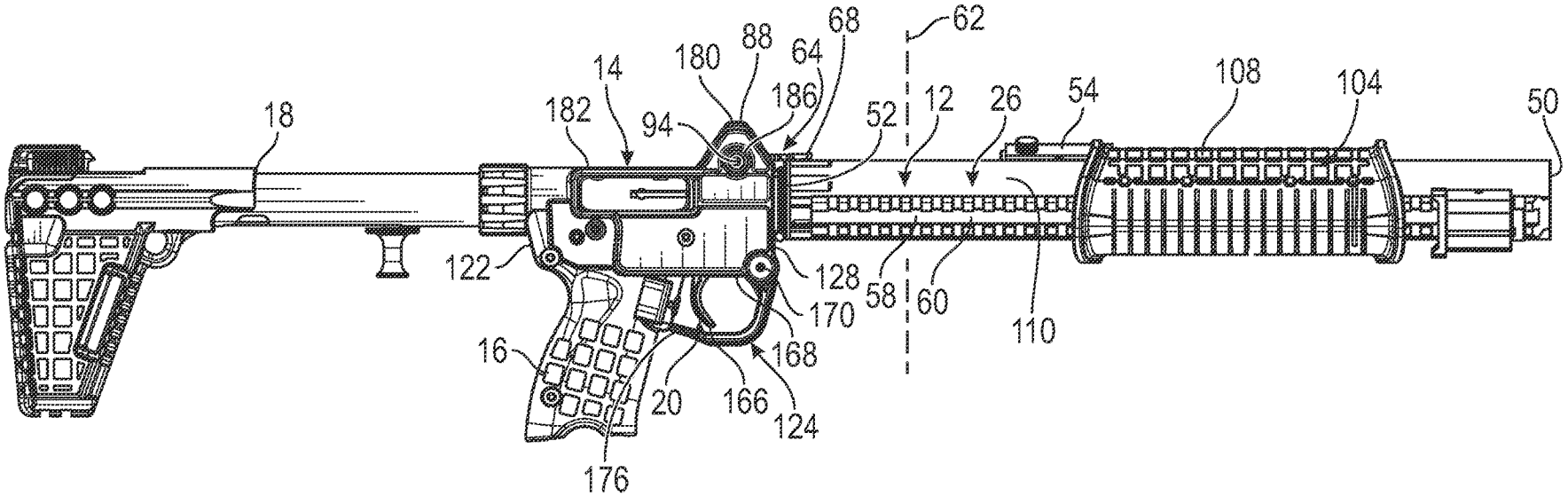
FIG. 4 is a right side view of the view of the folding firearm of FIG. 1 with the sleeve in the stowage condition.
Figure 5:
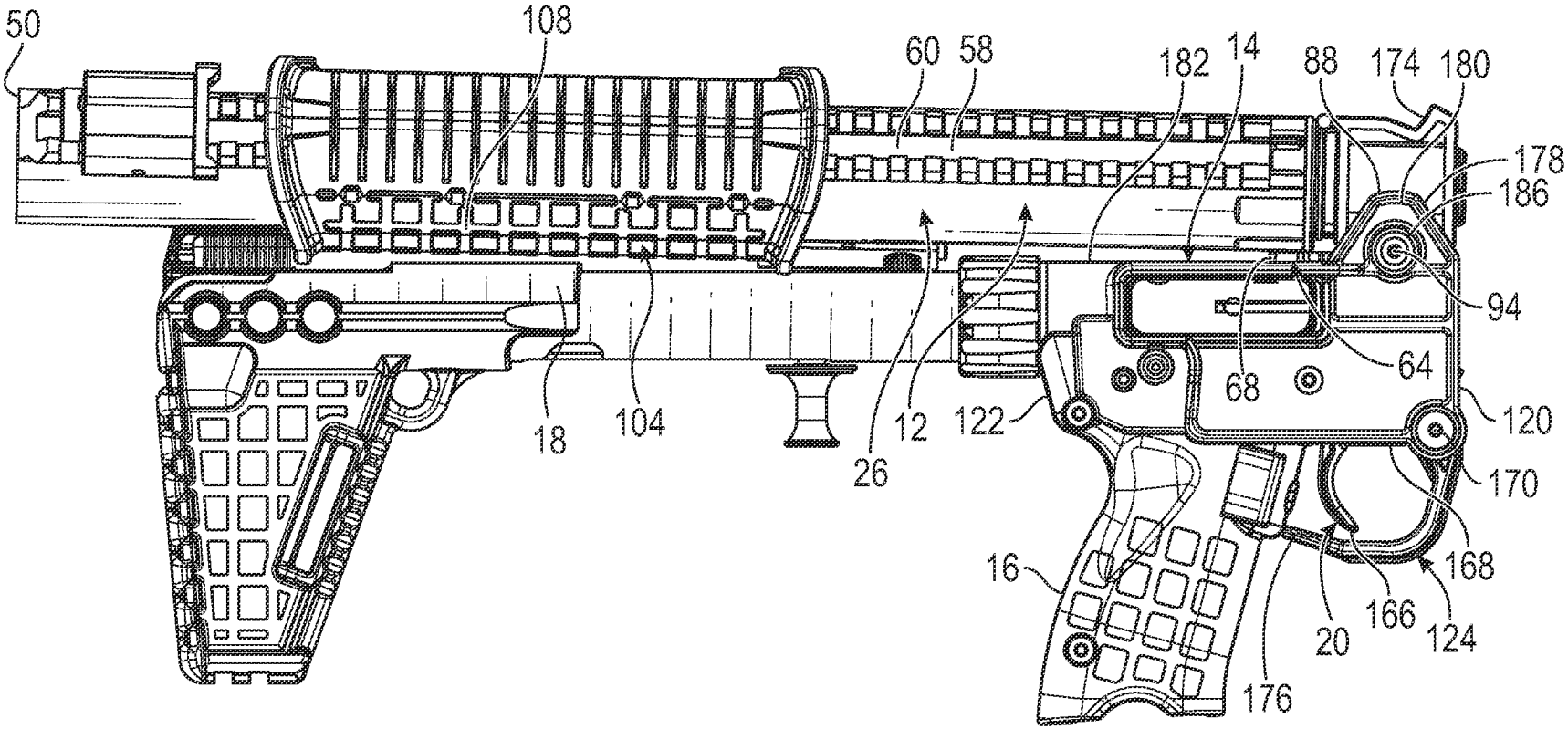
FIG. 5 is right side view of the folding firearm of FIG. 1 with the sleeve and folding firearm in the stowage condition.

FIGS. 1-5, 7, and 8 illustrate the improved folding firearm 10 of the present invention. More particularly, FIGS. 1 and 2 show the folding firearm in the unfolded condition with the sleeve 12 in the operating condition, FIGS. 3 and 4 show the folding firearm in the unfolded condition with the sleeve in the stowage condition, and FIG. 5 shows the folding firearm in the folded condition with the sleeve in the stowage condition. The folding firearm has a frame 14 with a grip 16 and a stock 18 attached to the rear 122. The frame also has a trigger assembly 20 and defines a passage 22 containing a bolt. A barrel assembly 26 is pivotally connected to the frame by a hinge 28 that serves as a pivot facility to move between an operating condition in which the barrel assembly extends away from the frame and a folded condition in which the barrel assembly is adjacent to the frame. The barrel assembly includes a barrel element 30 defining a barrel axis 32. The barrel element includes a barrel 34, a plurality of steel suppressor baffles 36 forward of the barrel, a plurality of aluminum suppressor baffles 38 forward of the plurality of steel suppressor baffles, and an interior space 40. The barrel assembly also includes the sleeve, which encompasses the barrel. The sleeve has an interior 42 defining an expansion chamber 44 in gas communication with the interior space of the barrel element. A front closure 46 and a rear closure 48 at respective ends of the sleeve (front 50 and rear 52) provide a gas seal enclosing the expansion chamber. In the current embodiment, the sleeve is rotatable about the barrel axis and includes a mounting rail 58 formed by a top 56 of the sleeve capable of receiving any compatible sight facility 54. Optionally, a bottom 58 of the sleeve forms an additional mounting rail 60.

In the current embodiment, the sleeve 12 is movable between an operating condition in which the folding firearm 10 is operable and the sight facility 54 is in a first position and a stowage condition in which the sight facility is rotationally offset from the first position. The amount of rotational offset of the sight facility from the first position can be 90° clockwise or counterclockwise in the current embodiment. The first position is on a medial plane 62 of the folding firearm. The sleeve is rotatable about the barrel axis such that the sight facility may be rotated aside to enable movement of the barrel assembly 26 to the folded condition depicted in FIG. 5. The hinge 28 includes a pivotally connected latch 64 that is operable to selectably secure the sleeve in the operating condition by engaging a latch pocket 66 defined by the top 56 of the sleeve with a forward portion 68. The interaction between the forward portion of the latch and the latch pocket ensures precise, repeatable alignment of the sight facility with the frame 14 each time the sleeve is returned to the operating condition from the stowage condition. As a result, the sight facility does not have to be zeroed again to restore accuracy to the folding firearm 10.

The barrel 34 includes a rifled portion 70. The barrel element 30 includes an inner tube 72 encompassing the plurality of steel suppressor baffles 36 and aluminum suppressor baffles 38. The inner tube also includes a plurality of rear end forward gas apertures 74, 76 providing gas communication between the interior space 40 of the barrel element, which is defined by the inner tube, and the expansion chamber 44 defined by the interior 42 of the sleeve 12. In the current embodiment, the sleeve is a single wall body, includes a mounting rail (mounting rail 58), is a unitary body, and is free of openings except at its front and rear ends 50, 52.

The hinge 28 has a top 78, bottom 80, front 82, and rear 84. The top of the hinge includes left and right ears 86, 88, each of which defines an aperture 90, 92 to enable the latch 64 to be pivotally connected to the hinge by a screw 94. The hinge also defines a central bore 96 that extends from the front to the rear. The rear 96 of the barrel 34 threads into the central bore, which allows the barrel assembly 26 to rotate about the barrel axis 32.

A left hand guard 98 having an interior 100 and an exterior 102 and a right hand guard 104 having an interior 106 and an exterior 108 have their interiors clamped against the exterior 110 of the sleeve 12 by a plurality of screws 112 threadedly received by a plurality of locking nuts 114. In the current embodiment, the left and right hand guards are made of polymer to prevent undesirable heat transfer from the sleeve to the user's hands. A bevel washer 116 presses against a washer 118 and the rear closure 48. This causes the washer to press against the front 120 of the frame 14 for tension when the folding firearm 10 is in the operating condition and presses the barrel assembly 26 into the trigger guard 124.

The rear closure 48 is a forend nut that has a rear 126 screwed into the hinge 28. The rear closure locks the barrel 34 in place so the barrel will not unthread from the hinge during rotation between the operating and stowage conditions. The rear closure also has threads on the front 128 that engage threads 130 in the rear 52 interior 42 of the sleeve 12 to enable the sleeve to rotate clockwise and counterclockwise about the barrel axis 32. The rear closure also serves as a gas seal for the rear of the expansion chamber 44. A central bore 132 that receives the rear 96 of the barrel is defined by the rear closure, and a flange 134 is located between the front and rear of the rear closure. An O-ring 136 assists the rear closure in creating the gas seal for the rear of the expansion chamber. The O-ring also creates intentional interference between the internal diameter of the rear interior of the sleeve and the front of the rear closure to remove any slack between the threads on the front of the rear closure and the rear interior of the sleeve.

The rear 96 of the barrel 34 defines a central bore 138 having a rifled portion 70 that is about 4.25 inches long in the current embodiment. The barrel is connected to the rear 140 of the inner tube 74. The exterior 142 of the inner tube defines a plurality of rear gas apertures 74 and forward gas apertures 76 that allow gases resulting from the discharge of the folding firearm 10 to vent into the expansion chamber 44. The front 144 of the inner tube threadedly receives a front closure 46 that serves as a gas seal for the front 50 of the expansion chamber. The front closure defines a central bore 146 that permits a bullet to exit the inner tube.

The interior space of the barrel assembly 26 defined by the inner tube 72 receives the plurality of steel suppressor baffles 36 and the plurality of aluminum suppressor baffles 38. The steel suppressor baffles have a front 148, rear 150, exterior 152, and define a plurality of gas passages 154 that communicate between the exterior and a central bore 154. There are four steel suppressor baffles in the current embodiment. The steel suppressor baffles are the rearmost suppressor baffles and are hardened to withstand the initial blast of gas pressure resulting from discharge of the folding firearm 10. The bullet passes through the central bores of the steel suppressor baffles, and the angled cone shape of the steel suppressor baffles assists in venting gases away from the traveling bullet. The steel suppressor baffles can also be made of other suitable materials capable of withstanding the operating environment. The aluminum suppressor baffles have a front 156, rear 158, exterior 160, and define a plurality of gas passages 162 that communicate between the exterior and a central bore 164. The aluminum suppressor baffles are located forward of the steel suppressor baffles and are subjected to reduced gas temperature and pressure compared to the steel suppressor baffles. The bullet passes through the central bores of the aluminum suppressor baffles, and the angled cone shape of the aluminum suppressor baffles assists in venting gases away from the traveling bullet. The aluminum suppressor baffles are longer than the steel suppressor baffles in the current embodiment and can be made of other suitable materials capable of withstanding the operating environment.

Figure 6:
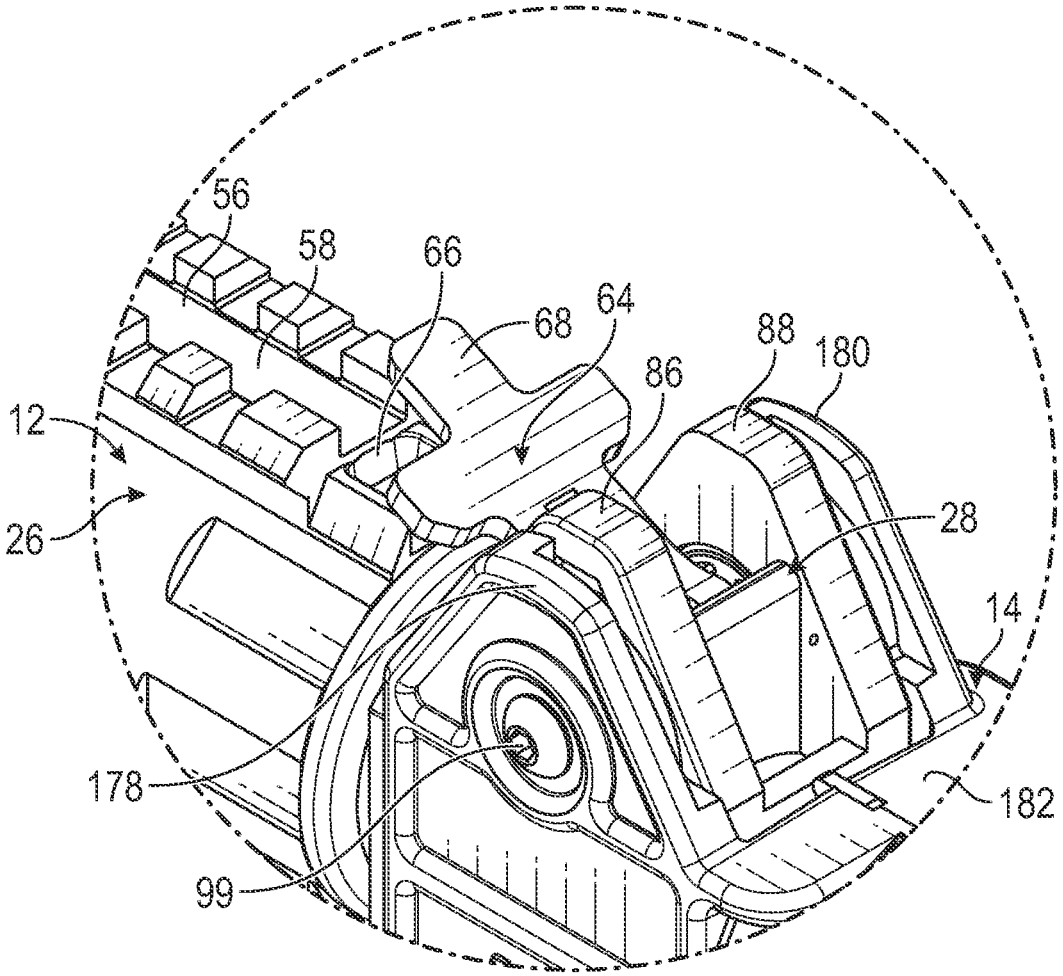
FIG. 6 is an enlarged top isometric view of the folding firearm of FIG. 1 with the latch in the unlatched condition raised above the sleeve.
Figure 7:
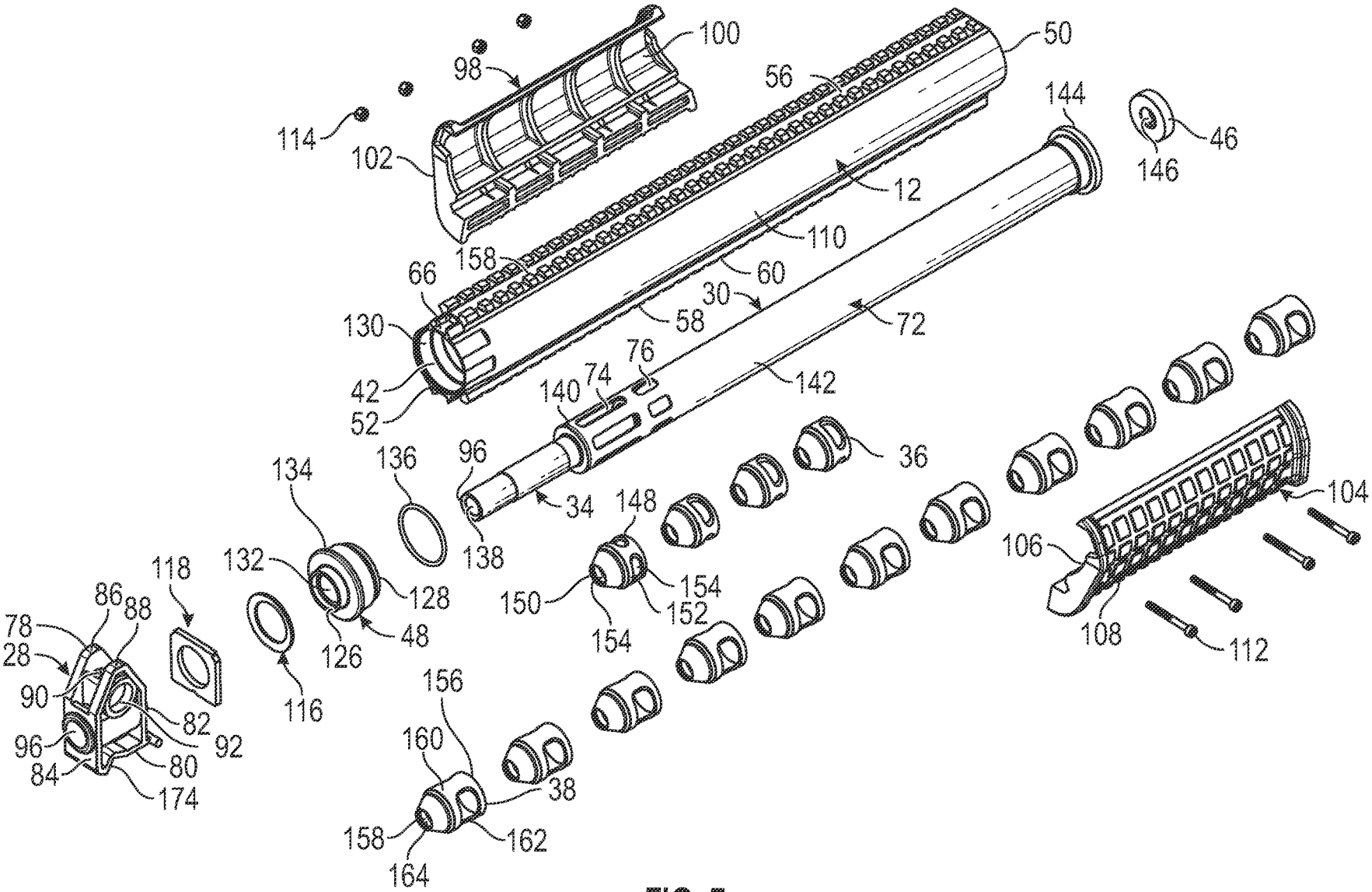
FIG. 7 is an exploded view of the folding firearm of FIG. 1.
Figure 8:
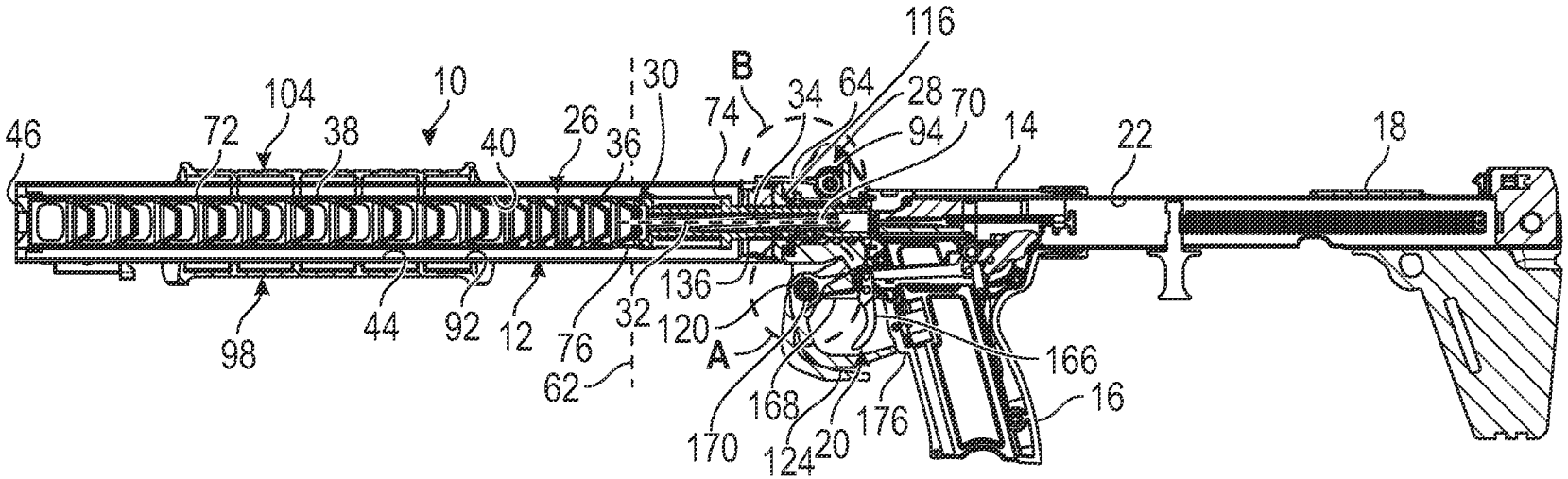
FIG. 8 is a side sectional view of the folding firearm of FIG. 1 with the sleeve in the stowage condition.
Figure 10:
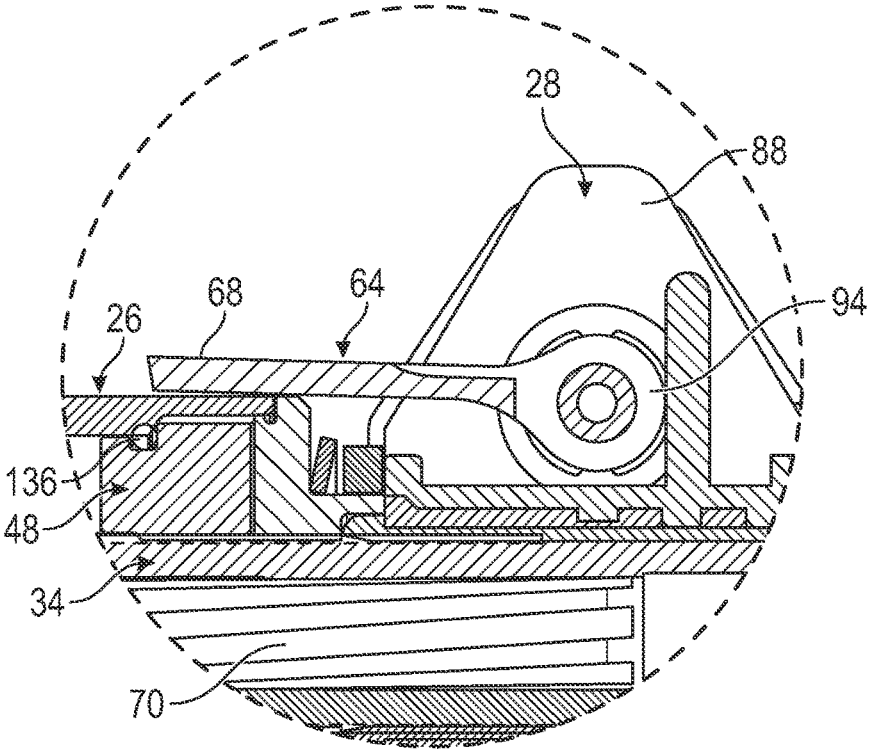
FIG. 10 is an enlarged side sectional view of the folding firearm of FIG. 1 showing the latch in the unlatched condition lowered onto the sleeve.

FIGS. 6 and 10 illustrate the improved folding firearm 10 of the present invention. More particularly, the latch 64 is shown with the forward portion 68 disengaged from the latch pocket 66. With the latch in the illustrated positions, the sleeve is free to rotate clockwise or counterclockwise about the barrel axis 32 to change the sight facility between the operating condition and the stowage condition. When the sleeve is in the operating condition, the forward portion of the latch is received by the latch pocket to prevent sleeve rotation. When the sleeve is in the stowage condition, the forward portion of the latch rests against the exterior 110 of the sleeve and does not prevent sleeve rotation.

Figure 9:
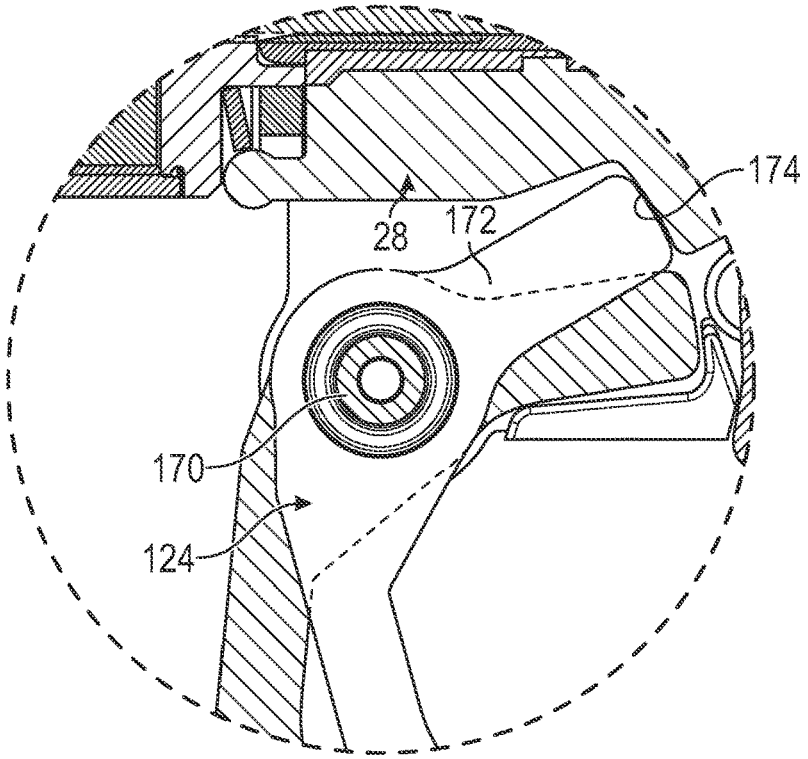
FIG. 9 is an enlarged side sectional view of the folding firearm of FIG. 1 showing the trigger guard in the latched and unlatched conditions.

FIG. 9 illustrates the improved folding firearm 10 of the present invention. More particularly, the trigger guard 124 that encircles the trigger 166 is pivotally connected to the bottom 168 front 120 of the frame 14 by a screw 170. The trigger guard pivots between the two positions shown to lock and unlock the hinge 28 from the frame. In the locked position, the trigger guard is positioned such that a forward portion 172 engages a step 174 that protrudes from the bottom 80 rear 84 of the hinge and a rearward portion 176 contacts the grip 16. In the unlocked position, the user has rotated the trigger guard clockwise such that the forward portion of the trigger guard disengages from and no longer obstructs the step on the hinge to permit the hinge to rotate about the screw 94 to transition the barrel assembly 26 from the operating condition to the folded position. Left and right ears 86, 88 on the hinge are received between left and right ears 178, 180 on the top 182 of the frame that each define an aperture 184, 186 that receives the screw. When the barrel assembly is in the operating condition, it should be appreciate that the hinge is received within the front 120 of the passage 22 in the frame.

While a current embodiment of a folding firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm comprising:

a frame having a trigger assembly and defining a bolt passage;

a barrel assembly pivotally connected to the frame;

the barrel assembly including a barrel element defining a barrel axis;

the barrel element including a barrel, a plurality of suppressor baffles forward of the barrel, and having an interior space;

the barrel assembly including a sleeve encompassing the barrel;

the sleeve having an interior defining an expansion chamber in gas communication with the interior space of the barrel element;

a front closure and a rear closure at respective ends of the sleeve to provide a gas seal enclosing the expansion chamber;

the sleeve being rotatable about the barrel axis; and wherein the sleeve has a sight facility.

2. The firearm of claim 1 wherein the sleeve is movable between an operating condition in which the firearm is operable and the sight facility is in a first position and a stowage condition in which the sight facility is rotationally offset from the first position.

3. The firearm of claim 2 wherein the first position is on a medial plane of the firearm.

4. The firearm of claim 1 including a latch operable to selectively secure the sleeve in the operating condition.

5. The firearm of claim 1 wherein the sleeve is a single wall body.

6. The firearm of claim 1 wherein the sleeve includes a mounting rail.

7. The firearm of claim 1 wherein the sleeve is a unitary body.

8. The firearm of claim 1 wherein the sleeve is free of openings except at its ends.

9. The firearm of claim 1 wherein the barrel assembly is pivotally connected to the frame to move between an operating condition in which the barrel assembly extends away from the frame and a folded condition in which the barrel assembly is adjacent to the frame.

10. A firearm comprising:

a frame having a trigger assembly and defining a passage containing a bolt;

a barrel assembly pivotally connected to the frame;

the barrel assembly including a barrel element defining a barrel axis;

the barrel element including a barrel, a plurality of suppressor baffles forward of the barrel, and having an interior space;

the barrel assembly including a sleeve encompassing the barrel;

the sleeve having an interior defining an expansion chamber in gas communication with the interior space of the barrel element;

a front closure and a rear closure at respective ends of the sleeve to provide a gas seal enclosing the expansion chamber;

the sleeve being rotatable about the barrel axis; and wherein the barrel element includes an inner tube encompassing the plurality of suppressor baffles.

11. The firearm of claim 10 wherein the inner tube includes a gas aperture providing gas communication between the interior space of the barrel element and the expansion chamber.

12. A folding firearm comprising:

a frame having a trigger assembly, and defining a bold passage;

a barrel assembly pivotally connected to the frame at a pivot facility and operable to move between an operating condition in which the barrel assembly extends away from the frame and a folded condition in which the barrel assembly is adjacent to the frame;

the barrel assembly including a barrel element defining a barrel axis;

the barrel element including a barrel and having an interior space;

the barrel assembly including a sleeve encompassing the barrel;

the sleeve including a sight facility; and the sleeve being rotatable about the barrel axis such that the sight facility may be rotated aside to enable movement of the barrel assembly to the folded condition.

13. The folding firearm of claim 12 including a latch operable to selectively secure the sleeve in the operating condition.

14. The folding firearm of claim 12 wherein the barrel element includes an inner tube encompassing the plurality of suppressor baffles.

15. The folding firearm of claim 14 wherein the inner tube includes a gas aperture providing gas communication between the interior of the inner tube and the expansion chamber.

16. The folding firearm of claim 12 wherein the sleeve is a single wall body.

17. The folding firearm of claim 12 wherein the sleeve includes a mounting rail.

18. The folding firearm of claim 12 wherein the sleeve is a unitary body.

19. The folding firearm of claim 12 wherein the sleeve is free of openings except at its ends.

* * * * *